US007399010B2

(12) United States Patent
Hunt et al.

(10) Patent No.: US 7,399,010 B2
(45) Date of Patent: Jul. 15, 2008

(54) POWER-ACTUATED MOTOR-VEHICLE DOOR LATCH WITH QUICK UNLOCK

(75) Inventors: Robert Hunt, Davisburg, MI (US); Keith Julien, Canton, MI (US)

(73) Assignee: Keykert USA, USA, Wixom, MI (US)

( * ) Notice: Subject to any disclaimer, the term of this patent is extended or adjusted under 35 U.S.C. 154(b) by 0 days.

(21) Appl. No.: 11/525,227

(22) Filed: Sep. 21, 2006

(65) Prior Publication Data

US 2008/0073915 A1 Mar. 27, 2008

(51) Int. Cl.
*E05C 3/06* (2006.01)

(52) U.S. Cl. ..... 292/201; 292/216; 292/DIG. 23

(58) Field of Classification Search ..... 292/216, 292/201, DIG. 23
See application file for complete search history.

(56) References Cited

U.S. PATENT DOCUMENTS 5,154,457 A * 10/1992 Watanabe ..... 292/216
5,833,282 A * 11/1998 Ikeda ..... 292/201
5,921,595 A * 7/1999 Brackmann et al. ..... 292/216
6,123,371 A * 9/2000 Fisher ..... 292/216
6,737,758 B2 5/2004 Weyerstall
6,932,393 B2 * 8/2005 Erices ..... 292/216
7,125,057 B2 * 10/2006 Coleman et al. ..... 292/216

FOREIGN PATENT DOCUMENTS

DE 102 47 842 11/2004
EP 1 288 408 5/2003

* cited by examiner

*Primary Examiner*—Patricia Engle
*Assistant Examiner*—Mark Williams
(74) *Attorney, Agent, or Firm*—Andrew Wilford

(57) ABSTRACT

A motor-vehicle door latch has a housing, latch parts in the housing operable to unlock a vehicle door, and an actuating element. A linkage engageable between the actuating element and the latch parts is shiftable between a coupled position for operation of the latch parts by the actuating element and a decoupled position operatively disconnecting the actuating element from the latch parts. A blocking element connected to the linkage is operable to shift the linkage between its coupled and decoupled positions. A drive motor operates the blocking element, and a quick-unlock element pivoted on the blocking element is operable by the drive.

12 Claims, 9 Drawing Sheets

POWER-ACTUATED MOTOR-VEHICLE DOOR LATCH WITH QUICK UNLOCK

FIELD OF THE INVENTION

The present invention relates to a motor-vehicle door latch. More particularly this invention concerns such a latch that is power actuated and that has a quick-unlock feature.

BACKGROUND OF THE INVENTION

A standard vehicle door latch has latch parts, at least one locking lever, at least one drive and a linkage between an actuating lever subassembly and the latch parts as well as a quick blocking element.

In motor vehicle door latches of this type, typically the drive moves the locking lever, which is normally configured as a central locking lever, to the locked or unlocked positions. Furthermore, in principle also further positions of the locking lever can be achieved, for example such as the so-called antitheft position.

The unlocking process is generally achieved with a keyless entry systems. These systems allow a vehicle user to carry an identification device, for example a code card, which initiates a dialog with a control system provided in the vehicle when the vehicle user approaches the vehicle or actuates the outside door actuating element, that is the door handle. During the course of this dialog, access authorization of the vehicle user seeking access is verified. Once the authorization has been verified, the control system sends a signal to at least one or all of the door latches of the motor vehicle. Then, the motor vehicle door latch is unlocked with the help of its drive and can then be opened mechanically, for example with the help of the outside door handle.

The problem with this is that a vehicle user seeking access has already operated the outside door handle while the dialog is still in process or before the associated motor vehicle door latch has assumed the unlocked position. The reason for this is that the above-mentioned keyless entry systems require a certain response time to carry out the unlocking operation. This response time includes an activation interval in order to activate the system as the vehicle user approaches, an authorization verification interval and finally the actual action interval.

In practice, response times of about 100 msec or more are known, which are perceived by the vehicle users as too long compared to conventional motor vehicle door latch systems. Furthermore, it is possible that the vehicle user has already operated the outside door handle in an attempt to open it before the associated motor-vehicle door latch has assumed the unlocked position. The vehicle user then has to release the outside door handle and perform another confirmation step, which is considered a clear limitation in terms of convenience.

For this reason, quick-unlock systems have been developed that use quick-unlock elements. They all share the basic principle of bridging or shortening the comparatively long unlocking path of the locking lever and/or central locking lever in that the quick-unlock element allows the mechanical opening of the associated motor vehicle door latch practically immediately following actuation of the drive.

In particular, German 102 47 842 of Brose provides that shifting of the central locking arrangement from the locked to the unlocked state initially effects a movement of the linkage and/or linkage arrangement from the locked into the unlocked state and thereafter a movement of the inside blocking element from the locked to the unlocked state. For this purpose, a quick-unlock lever is provided, the locking lever and the quick-unlock lever being moved to the unlocked and locked states by means of the drive. The quick-unlock lever is coupled to the linkage arrangement, specifically via a linkage rod. The known configuration has proven useful in principle, however it has an overall uninviting design because the quick-unlock lever is mounted on the locking lever and/or both pivot about the same axis of rotation.

A similar system is seen in EP 1 288 408 of Scholz. This system offers a further development in that the quick-unlock lever releases the latch parts during the course of the quick-unlock operation with the help of the drive, substantially independently of the position of the locking lever. The quick-unlock lever is configured as a one-arm lever that is pivoted on the locking lever. In the system of U.S. Pat. No. 6,737,758 of Weyerstall, s the quick-unlock element can be connected to the lock mechanism and/or a blocking element in a more or less integral manner. Within the framework of an alternative, the quick-unlock element can be configured as a spring snap element, which is released by the drive and snaps into its actuation position under spring force.

OBJECTS OF THE INVENTION

It is therefore an object of the present invention to provide an improved power-actuated motor-vehicle door latch with quick unlock.

Another object is the provision of such an improved power-actuated motor-vehicle door latch with quick unlock that overcomes the above-given disadvantages, in particular that is particularly compact configuration and that functions smoothly and quickly.

SUMMARY OF THE INVENTION

A motor-vehicle door latch has according to the invention a housing, latch parts in the housing operable to unlock a vehicle door, an actuating element, means in the housing including a linkage engageable between the actuating element and the latch parts and shiftable between a coupled position for operation of the latch parts by the actuating element and a decoupled position operatively disconnecting the actuating element from the latch parts, a blocking element connected to the linkage and operable to shift the linkage between its coupled and decoupled positions, drive a drive motor for operating the blocking element, and a quick-unlock element pivoted on the blocking element and operable by the drive means.

In other words, according to the invention a motor vehicle door latch according to the invention is characterized in that the quick-unlock element is mounted pivotably on a blocking element that actuates the linkage and interacts with this element.

The blocking element ensures that the linkage can be coupled and decoupled. In the coupled position, the linkage establishes a continuous mechanical connection from the actuating lever subassembly to the latch parts, so that the latch parts can be opened, for example, with an outside actuating lever or handle of the actuating lever subassembly. However, when the linkage is in the decoupled position, operating the outside actuating lever or an inside actuating lever of the actuating lever subassembly means that the actuating lever subassembly performs an idle stroke and the latch parts cannot be opened. The continuous mechanical connection from the respective actuating lever to the latch parts is therefore interrupted in this position of the linkage.

The blocking element, which in turn actuates the linkage, is operated with the help of the quick-unlock element. This procedure is used particularly during quick unlocking. The quick-unlock element is preferably moved in two angular directions relative to the blocking element with the help of the drive. When the drive, starting with the locked position and with a decoupled linkage, is moved in the unlocked direction, it ensures in conjunction with the quick-unlock element that the blocking element is operated after only a short travel distance of the drive and is consequently pivoted by the drive. As a result, this pivot motion of the quick-unlock element causes the blocking element for the linkage to pivot, so that it is moved from the original decoupled position in the locked position of the motor vehicle door latch to the coupled position. This way, the latch parts can be opened directly with the help of the actuating lever subassembly.

In detail, the interaction between the quick-unlock element and the blocking element occurs such that the quick-unlock element is coupled to the blocking element via a pin of the blocking element, which pin engages in the quick-unlock element. This means that the pin in question is connected to the blocking element and/or that the pin and blocking element are configured as one piece, the pin projecting perpendicularly from the blocking element and engaging in the quick-unlock element. The pin advantageously engages in an associated actuating recess of the blocking element. Furthermore, it has proven useful if the respective pin engages in another actuating recess of a transmission lever.

This transmission lever is usually pivoted on the blocking element. Furthermore, the transmission lever is pivoted on the locking lever.

From a design point of view it has proven useful if the blocking element is configured as a one-arm blocking lever. Its lever end located opposite an axis of rotation is used to operate a link of the linkage. The link is prestressed in the coupled direction. This means, for example, that when operation of the link is eliminated during quick unlocking, the lever transitions into the coupled position nearly without hesitation. As a result, the desired mechanical connection exists between the actuating lever subassembly and the latch parts so that the latch parts can be opened.

In general, the blocking element rests against the link so that the link follows the movements of the blocking element, which is in turn pivoted with the help of the transmission lever connected to the locking lever. This procedure only changes when the quick-unlock operation is performed. During the course of the quick-unlock operation, the blocking element is pulled off the link. Since the link is prestressed in the coupled direction of the linkage, the link then moves into the coupled position, pushed or pulled there by a spring.

Consequently, a motor vehicle door latch is provided that is of particularly compact design. The quick-unlock element that interacts substantially with an actuating pin of the drive is generally configured as a compact one-way lost-motion coupling. This coupling and/or the quick-unlock element are mounted on the blocking element and not, as is the case in the related art, on the locking lever. This way, the linkage, and along with it the link as well as the latch parts can be offset by 90° relative to the locking lever and the drive. As a result, the quick-unlock element and the blocking element interacting therewith perform substantial pivot movements in the same plane as the locking lever and the drive.

These pivot movements of the quick-unlock element, and of the blocking element, are transmitted to the link that is oriented substantially perpendicularly and extends in the same plane as the linkage and the latch parts. This is possible without difficulty because the link is prestressed in the coupled direction and the blocking element operates on a pin on the link.

During transition from the unlocked to the locked position and back with the exception of the quick unlocking operation, the blocking element, which is configured as a one-arm blocking lever, rests with its lever end opposite its axis of rotation on the respective pin of the link of the linkage. The respective lever end only leaves the pin during the quick-unlock operation, so that the link immediately assumes the coupled position due to the spring tension. The same also applies to the linkage.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
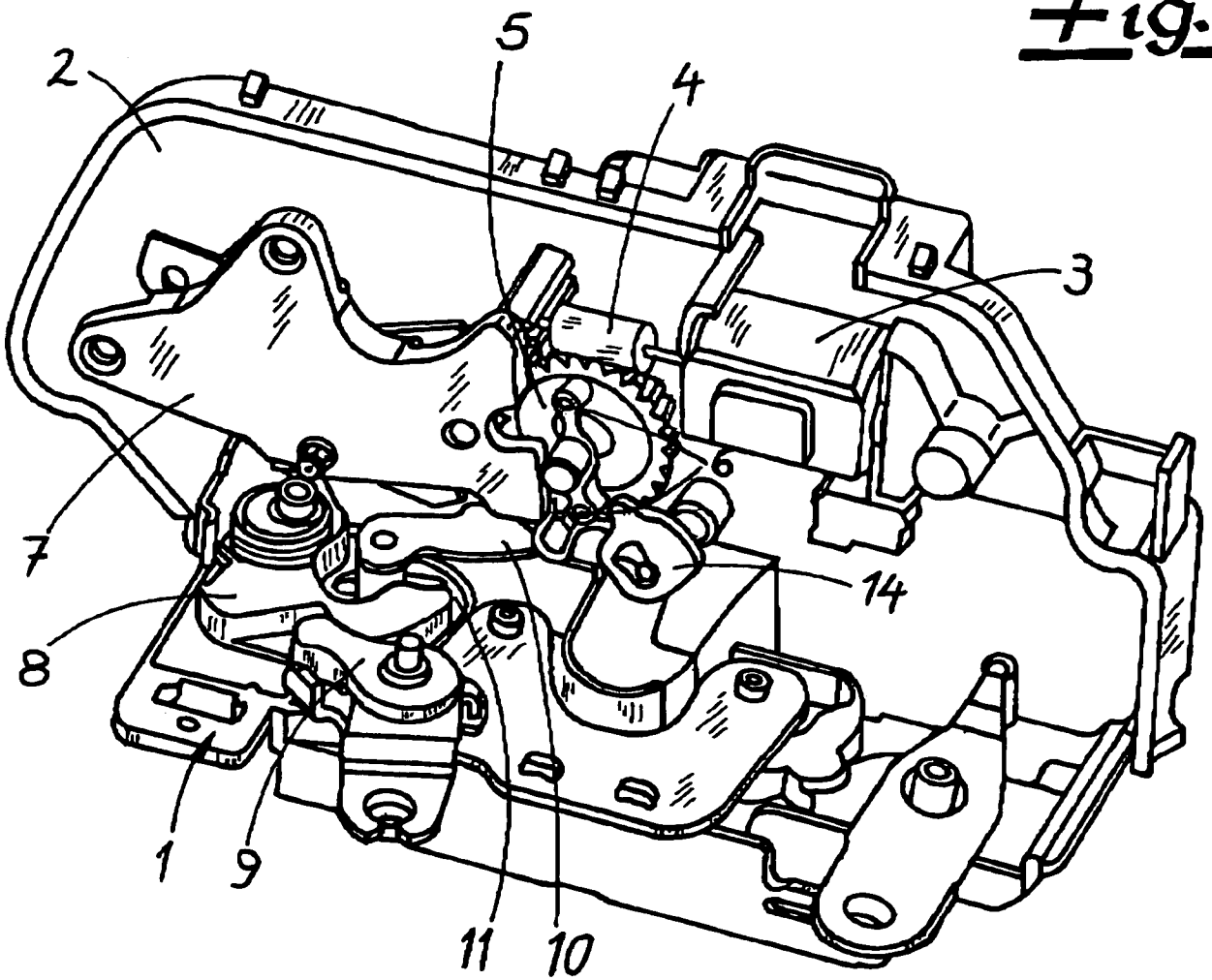
FIG. 1 is a perspective view of the latch according to the invention.
Figure 2:
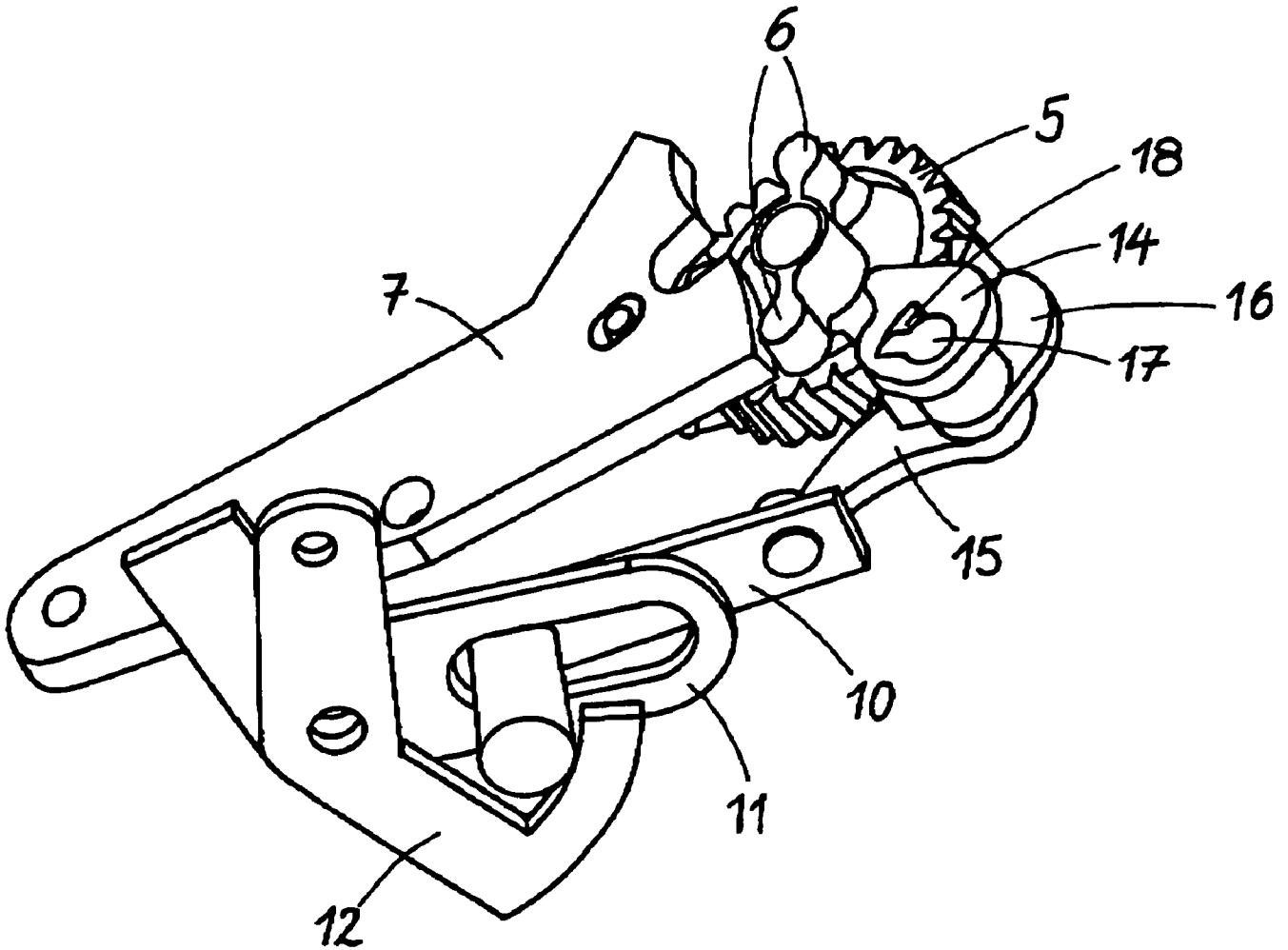
FIG. 2 show a subassembly comprised of the latching lever, the drive, the quick-unblocking element, and the linkage.

As seen in FIG. 1 a motor vehicle door latch has a lock plate 1 as well as a lock housing 2 that extend perpendicular to each other and that support a drive 3, 4, 5, 6. The drive 3, 4, 5, 6 comprises an electric motor 3, a drive worm gear 4, a control gear 5 as well as two diametrally opposite actuating formations or pins 6 carried on the control gear 5. The control gear 5 is mounted on a pivot 20 in the lock housing 2. A locking lever 7 is mounted on a parallel pivot 21, and these elements form part of a central power locking and unlocking system.

Figure 3A:
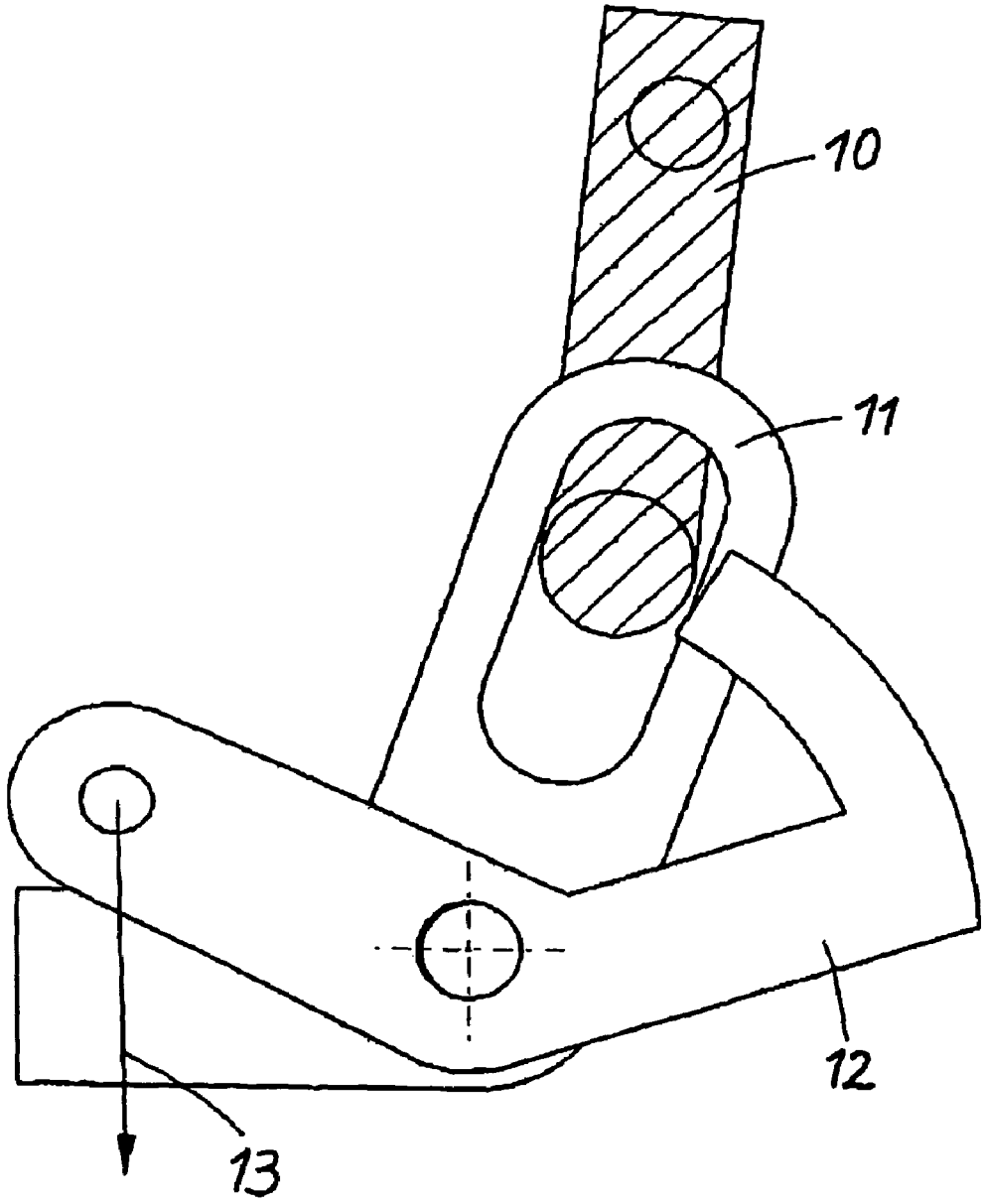
FIGS. 3*a* and 3*b* show the linkage respectively in the coupled and decoupled positions.
Figure 3B:
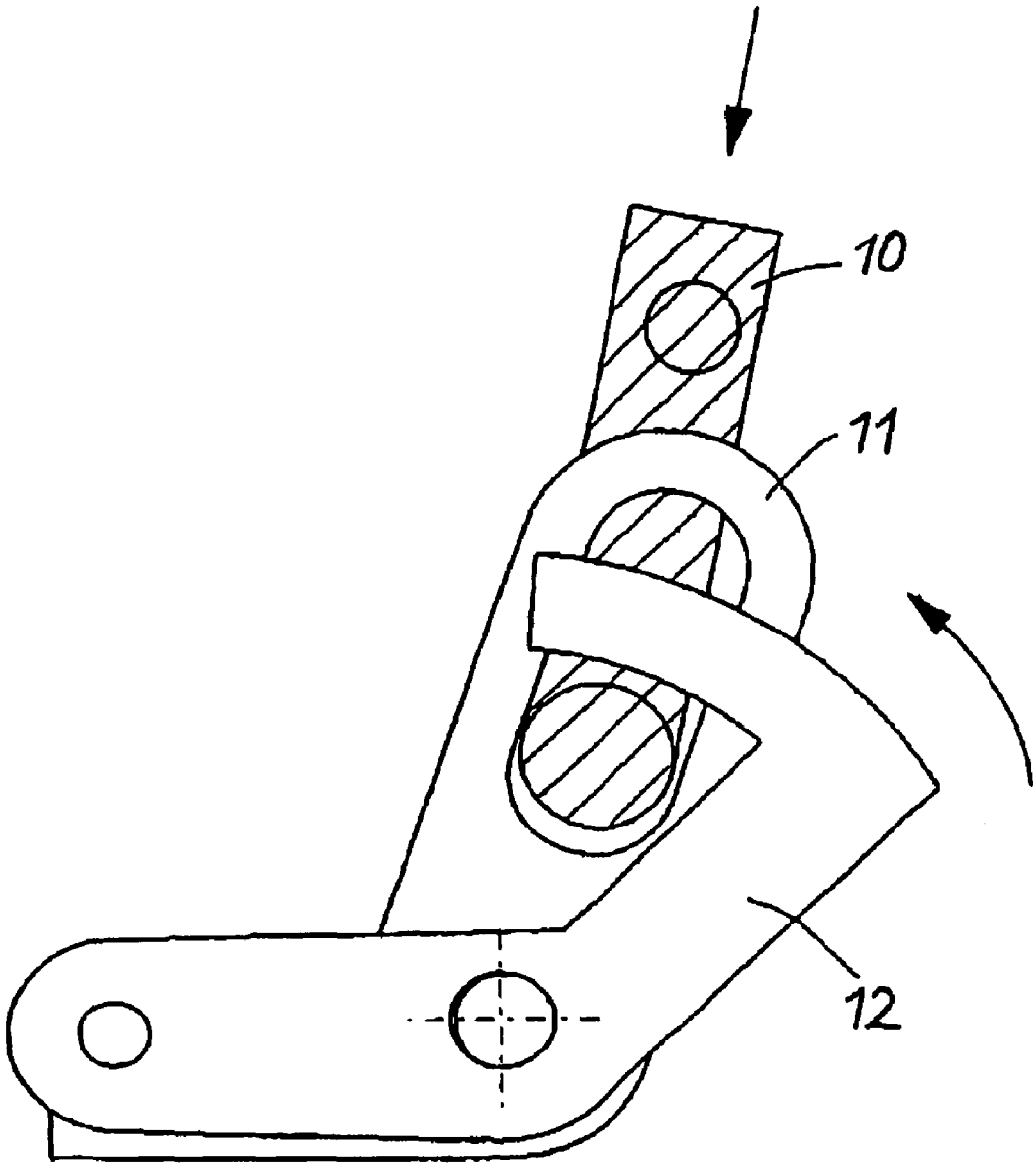

The vehicle door latch also includes latch parts 8 and 9 having a rotary latch fork 8 and a retaining pawl 9 interacting with it, both mounted in the lock plate 1. As is standard, the housing 2 is mounted on a door edge so that the fork 8 can engage around a post-mounted bolt and hold the door closed. A linkage 10, 11, 12 is connected between an actuating lever subassembly 13 and the latch parts 8, 9, so that as shown in FIGS. 3*a* and 3*b*, clockwise rotation of a link 11 pulls back the pawl 9 and allows the fork 8 to release the door. The subassembly 13 is typically connected to a door handle illustrated schematically at 23 in FIG. 3*a*. Finally, a quick-unlock element 14 is part of the basic configuration.

Figure 4A:
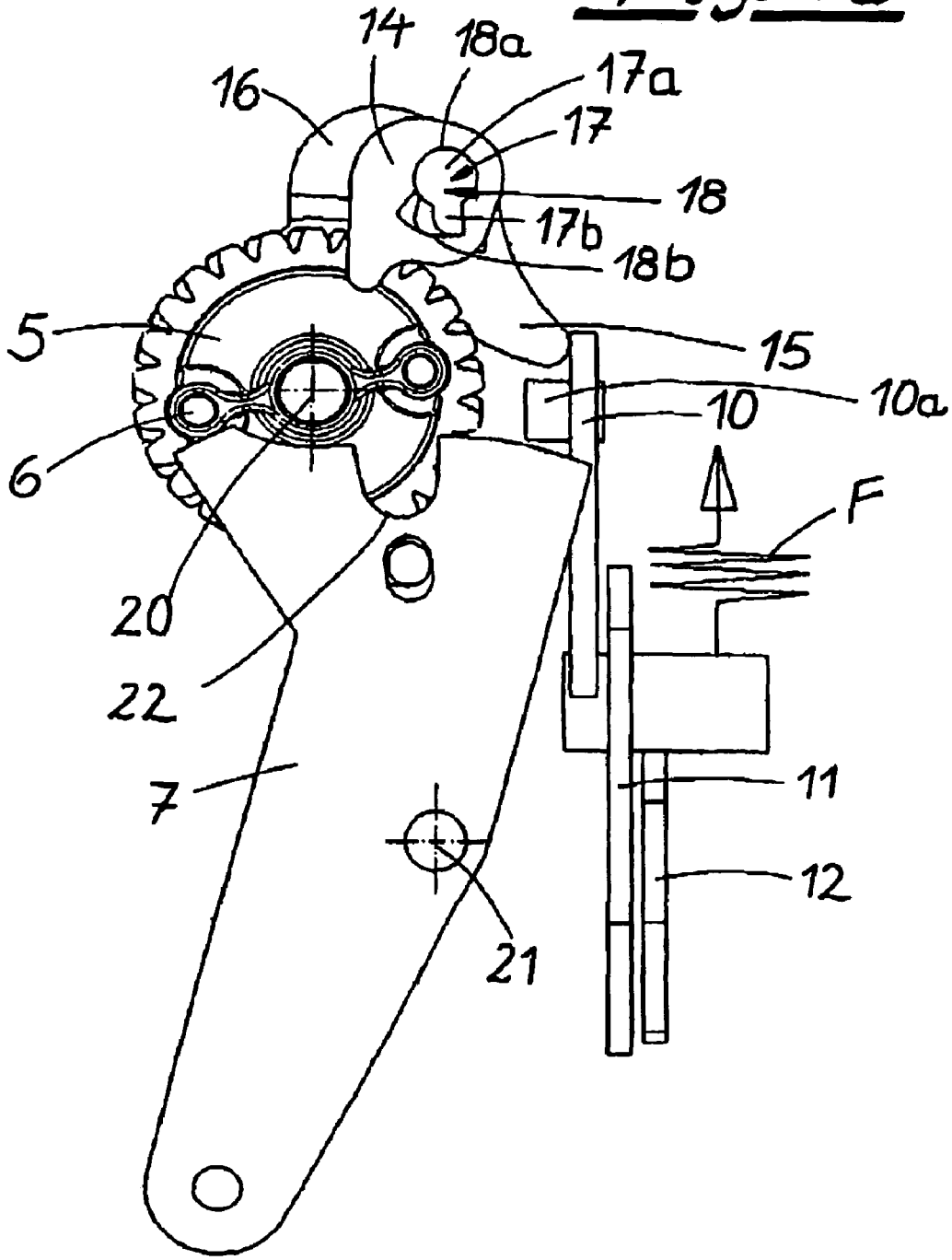
FIGS. 4*a*, 4*b*, and 4*c* show the latching lever with the linkage and blocking element in a front view respective in the unlatched, locked, and quick-locked positions.
Figure 4B:
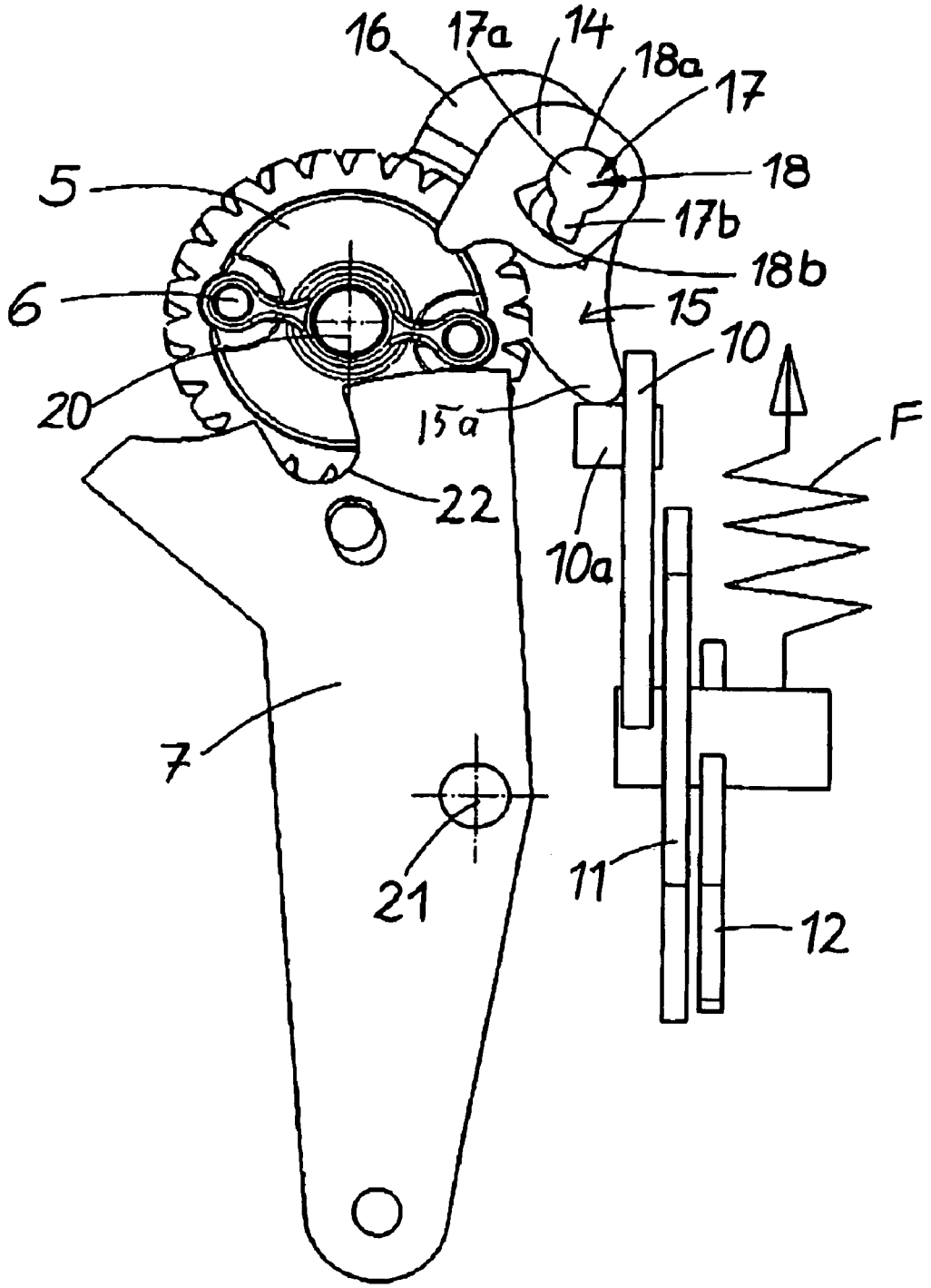
Figure 4C:
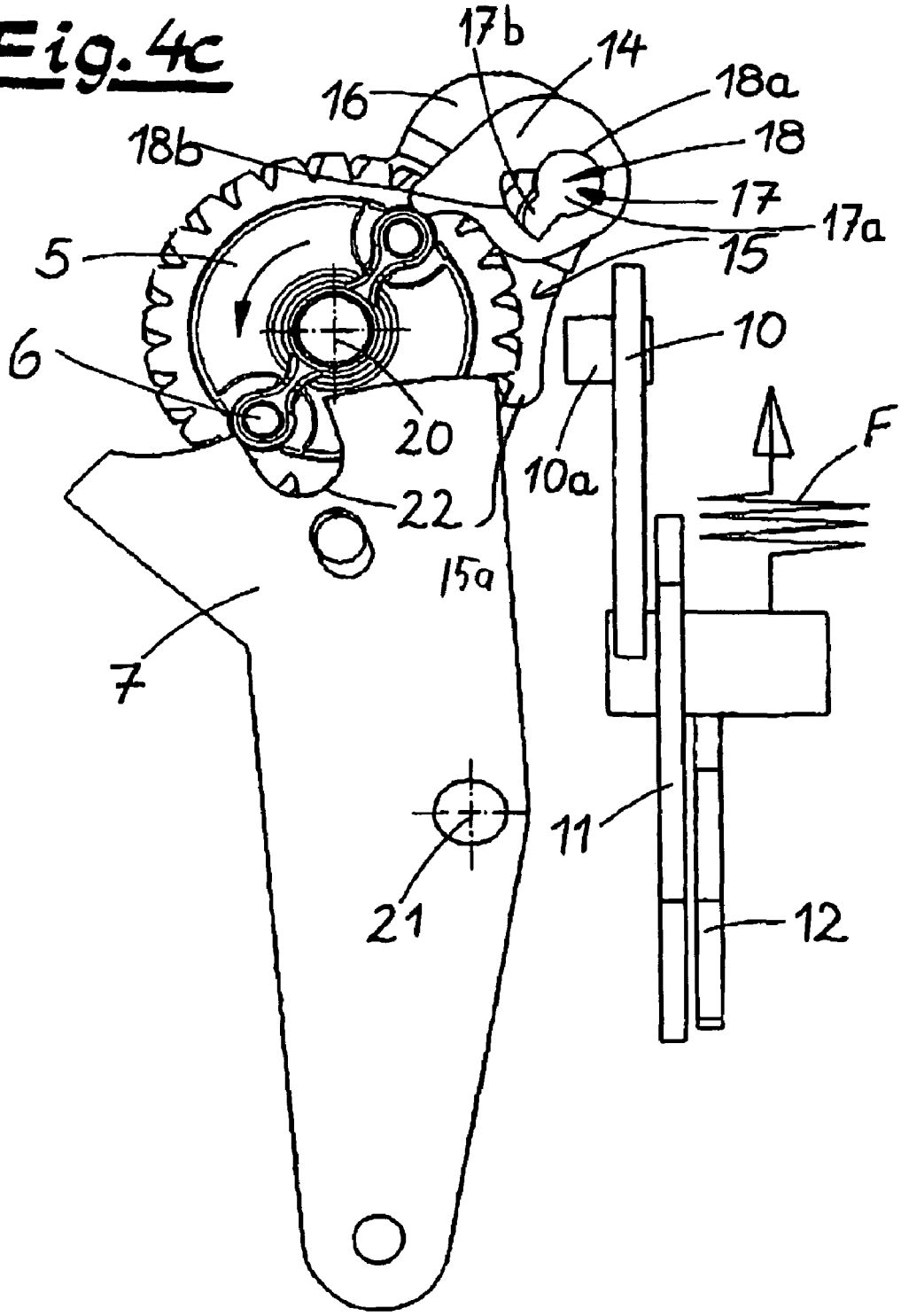

FIGS. 4*a* to 4*c* show that the quick-unlock element 14 is mounted coaxially and pivoted about a blocking element 15 that actuates the linkage 10, 11, 12 and interacts with this blocking element 15. Further, the blocking element 15 is pivoted on a transmission lever or element 16. The locking lever 7, the drive 3, 4, 5, 6, and the control gear 5 lie in a plane on the flat housing 2 that is generally perpendicular to the plate 1 and the linkage 10, 11, 12 and latch parts 8, 9.

The quick-unlock element 14 can be pivoted in two directions relative to the blocking element 15 by the drive 3, 4, 5, 6. More particularly, the quick-unlock element 14 is configured as a ratchet that interacts with the actuating pin 6 of the drive 3, 4, 5, 6. Consequently, the quick-unlock element 14 acts as a blocking wheel that pivots the blocking element 15 one way or another as it is oscillated by the drive 3, 4, 5, 6. This means that the quick-unlock element and/or the ratchet 14 do not perform a full rotation, but instead just oscillate or move back and forth.

To this end, the quick-unlock element 14 is coupled to the blocking element 15 via a pin 17 that engages through the blocking element 15 and that fits in an actuating hole 18 of the quick-unlock element 14. The pin 17 also extends into a further actuating hole 19 of the transmission lever 16. Thus the pin 17, which projects perpendicularly from the blocking element 15 and engages in both the transmission lever 16 and the blocking element 14, pivotally supports both the blocking element 14 and the transmission lever 16 on the blocking element 15.

The pin 17 comprises a cylindrical bearing part 17*a* and an actuating part 17*b* connected to the cylindrical bearing part 17*a*. The two actuating holes 18 and 19 of the quick-unlock element 14 and of the lever 16, through which the pin 17 passes accommodate this shape in that they have respective bearing portions 18*a* and 19*a* as well as pivot portions 18*b* and 19*b*. The actuating part 17*b* engaging in the pivot portions 18*b* and 19*b* can be moved back and forth in the portion 18*b* and 19*b* only across a limited rotational angle to create a one-way lost-motion coupling between each of the elements 14 and 16 and the element 15.

Figure 5:
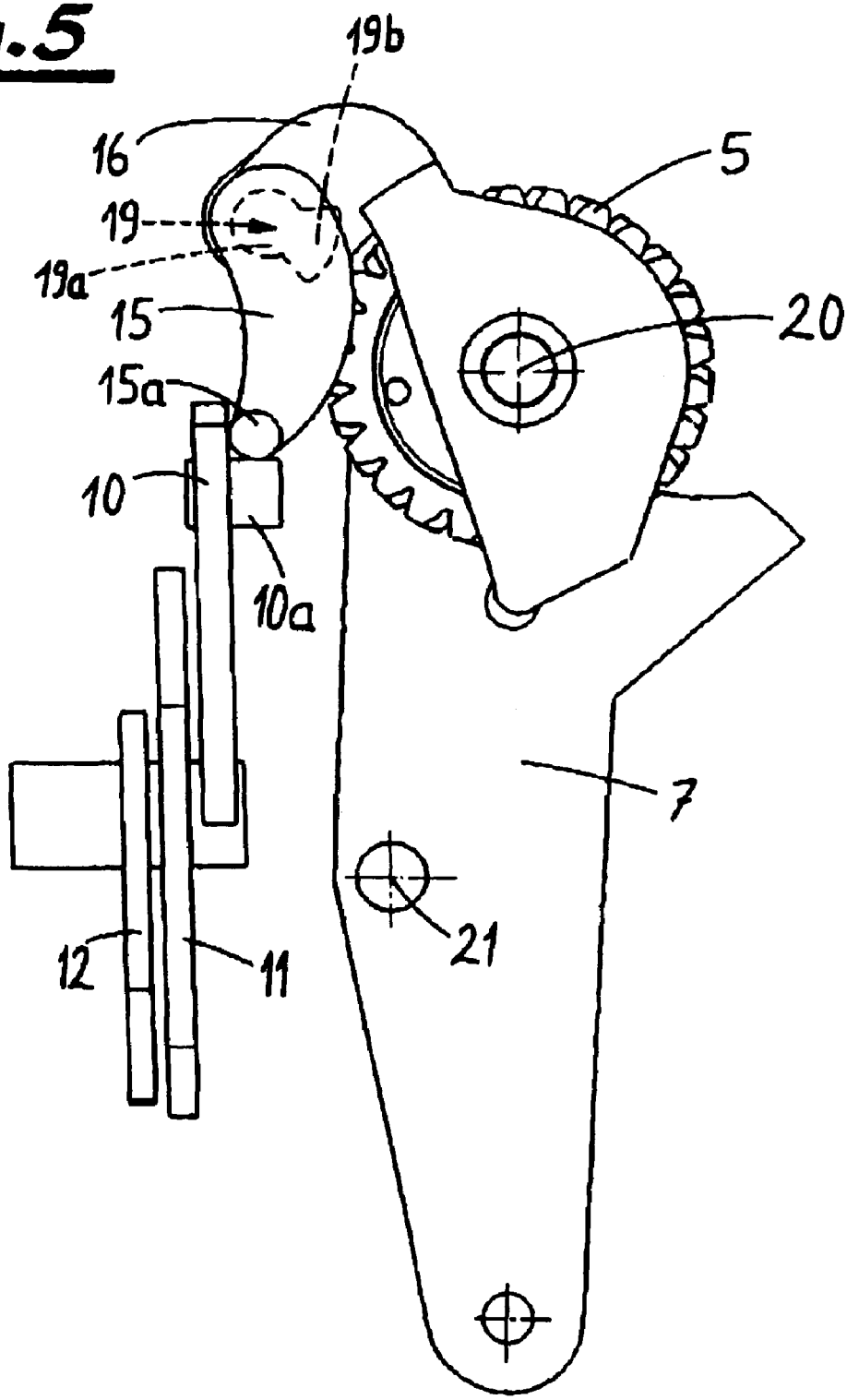
FIG. 5 is a back view of the structure as shown in FIG. 4*b;*.
Figure 6:
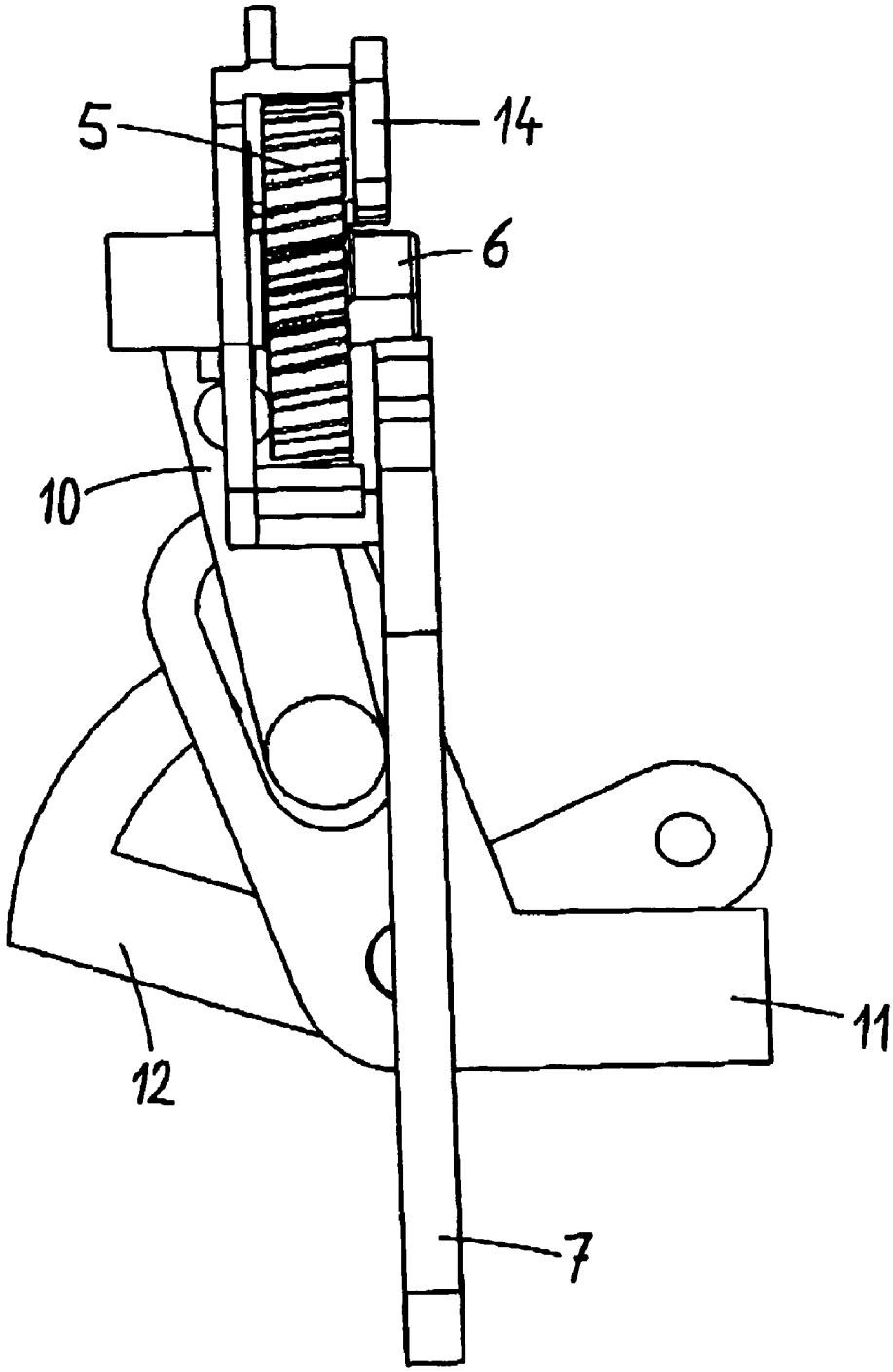
FIG. 6 is a side view of the structure shown in FIGS. 4*a*-4*c* and 5.

The blocking element 15 is pivoted on the transmission lever 16, which in turn is pivoted on the locking lever 7, as illustrated particularly in the rear view in FIG. 5. In detail, the blocking element 15 is configured as a one-arm lever that operates a link 10 of the linkage 10, 11, 12 with its lever end 15*a* opposite the axis of rotation defined by the pin 17. The above-mentioned link 10 is prestressed in the coupled direction of the linkage 10, 11, 12. More particularly, a spring F illustrated schematically in FIGS. 4*a* to 4*c* ensures this function, which is as follows.

When starting in the unlocked position of the motor vehicle door latch according to FIG. 4*a*, the central locking lever 7 is shifted to the locked position according to FIG. 4*b* by clockwise rotation of the control gear 5 by the drive 3, 4, 5, 6 about its axis 20 as shown in FIGS. 4*a* and 4*b* through about 360°. More particularly, the locking lever 7 is subjected to the corresponding counter-clockwise rotation about its axis 21, in that one of the actuating pins 6 of the drive 3, 4, 5, 6 engages into an actuating seat or recess 22 on the locking lever 7 and thus ensures the required counter-clockwise pivoting about its axis 21 during the transition from the position of FIG. 4*a* to that of FIG. 4*b*. On such clockwise movement, the pin 6 engages the quick-unlock element 14 and pivots it clockwise without moving the elements 15 or 16.

In this FIG. 4*b* position, the motor vehicle door-latch has assumed the locked position. The transmission lever 16 is carried along at the same time as the locking lever 7, as is the quick-unlock element 14. The transition from unlocked to locked position corresponds to such counter-clockwise rotation of the transmission lever 16 in the rear view according to FIG. 5 about the axis 20 it has in common with the control gear 5, so that the blocking element 15 that is connected via the pin 17 pushes the link 10 downward.

As soon as the link 10 moves downward against the force of the spring F as shown in FIG. 3*a*, from the coupled position of the linkage 10, 11, 12, the two links 11 and 12 of the linkage 10, 11, 12 are no longer mechanically connected. The linkage 10, 11, 12 changes from the coupled position to the decoupled position.

In fact, in the coupled position the actuating lever subassembly 13 engages on the link 12 and can open the latch parts 8, 9 via the closed linkage 10, 11, 12 when the link 10 has assumed the position according to FIG. 3*a*. The two linkage elements 11, 12 are in this position mechanically coupled.

However, if the link 10 has assumed the decoupled position according to the illustration in FIG. 3*b*, no mechanical connection exists any longer between the actuating lever subassembly 13 and the latch parts 8, 9, so that movement of the actuating lever subassembly 13 is without effect and the latch parts 8, 9 cannot be opened. This decoupled position of the linkage 10, 11, 12 corresponds to the locked position of the motor vehicle door latch, which is illustrated in FIG. 4*b*.

If a quick unlocking operation is now performed starting with the position of FIG. 4*b* and moving into that of FIG. 4*c*, the actuating pin 6 of the drive 3, 4, 5, 6 is rotated counter-clockwise to engage and trip the quick-unlock element 14 is with less than 20% of the conventional angular travel required to activate linkage element 10. Consequently, the quick-unlock element 14 is pivoted clockwise and entrains the blocking element 15. As a result, the lever end 15*a* of the blocking element 15 pulls off the link 10 by moving out of engagement with a pin 10*a* of the link 10.

The link 10 is then moved upward by the force of the spring F, and, starting from the position according to FIG. 3*b*, is moved into the coupled position in accordance with FIG. 3*a*. The actuating lever subassembly 13 can then directly open the latch parts 8, 9 because now there is a mechanical connection between the actuating lever subassembly 13 and the latch parts 6, 9 via the coupled linkage 10, 11, 12. As shown in FIG. 4*c*, the control gear 5 and the transmission lever 16 are shifted, so that at the end of this movement the motor vehicle door latch has reached the unlocked position according to FIG. 4*a*.

What is claimed is:

1. A motor-vehicle door latch comprising:

a housing;

latch parts in the housing operable to unlock a vehicle door;

an actuating element;

means in the housing including a linkage engageable between the actuating element and the latch parts and shiftable between a coupled position for operation of the latch parts by the actuating element and a decoupled position operatively disconnecting the actuating element from the latch parts;

a blocking element connected to the linkage and operable to shift the linkage between its coupled and decoupled positions;

drive means including a drive-motor for operating the blocking element; and a quick-unlock element pivoted on the blocking element, coupled to the linkage, and operable by the drive means to unlock the vehicle door directly on operation of the drive means.

2. The motor-vehicle door latch defined in claim 1 wherein the quick-unlock element is pivotal in two directions by the drive means relative to the blocking element.

3. The motor-vehicle door latch defined in claim 2, further comprising a pin passing through and coupling together the blocking element and the quick-unlock element.

4. The motor-vehicle door latch defined in claim 3 wherein the blocking element is formed with a hole in which the pin engages.

5. The motor-vehicle door latch defined in claim 4, further comprising a transmission lever formed with a hole into which the pin also engages.

6. The motor-vehicle door latch defined in claim 5 wherein the drive includes an orbital formation engageable with the quick-unlock element and forming therewith a one-way coupling between the formation and the blocking element.

7. The motor-vehicle door latch defined in claim 5 wherein the blocking element is pivotal on the transmission lever.

8. The motor-vehicle door latch defined in claim 7 wherein the blocking element has one end pivoted on the transmission lever and an opposite end engageable with a link of the linkage.

9. A motor-vehicle door latch comprising:

a housing;

latch parts in the housing operable to unlock a vehicle door;

an actuating element;

means in the housing including a linkage engageable between the actuating element and the latch parts and shiftable between a coupled position for operation of the latch parts by the actuating element and a decoupled position operatively disconnecting the actuating element from the latch parts;

a blocking element connected to the linkage, formed with a hole, and operable to shift the linkage between its coupled and decoupled positions;

drive means including a drive motor for operating the blocking element;

a quick-unlock element pivotal in two directions by the drive means relative to the blocking element;

a pin passing through the quick-unlock element and the hole of the blocking element and coupling together the blocking element and the quick-unlock element;

a transmission lever formed with a hole into which the pin also engages, whereby the blocking element is pivotal on the transmission lever; and spring means urging the linkage into the coupled position.

10. The motor-vehicle door latch defined in claim 9 wherein on quick unlocking the blocking element disengages from the link and the spring means returns the linkage to the coupled position.

11. A motor-vehicle door latch comprising:

a housing;

latch parts in the housing operable to unlock a vehicle door;

an actuating element;

means in the housing including a linkage engageable between the actuating element and the latch parts and shiftable between a coupled position for operation of the latch parts by the actuating element and a decoupled position operatively disconnecting the actuating element from the latch parts;

a blocking element connected to the linkage and operable to shift the linkage between its coupled and decoupled positions;

drive means including a drive motor for operating the blocking element; and a quick-unlock element pivoted on the blocking element and operable by the drive means; and spring means urging the linkage into the coupled position.

12. The motor-vehicle door latch defined in claim 11 wherein on quick unlocking the blocking element disengages from the link and the spring means returns the linkage to the coupled position.

* * * * *